US012642300B2

(12) United States Patent
Lv et al.

(10) Patent No.: US 12,642,300 B2
(45) Date of Patent: Jun. 2, 2026

(54) VAPORIZATION CORE, VAPORIZER, AND ELECTRONIC VAPORIZATION DEVICE

(71) Applicant: SHENZHEN SMOORE TECHNOLOGY LIMITED, Guangdong (CN)

(72) Inventors: Hongxia Lv, Shenzhen (CN); Pei Li, Shenzhen (CN); Zhenlong Jiang, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 334 days.

(21) Appl. No.: 18/191,398

(22) Filed: Mar. 28, 2023

(65) Prior Publication Data

US 2023/0337741 A1 Oct. 26, 2023

(30) Foreign Application Priority Data

Apr. 20, 2022 (CN) ..... 202210418914.4

(51) Int. Cl.
*A24F 40/46* (2020.01)
*A24F 40/10* (2020.01)

(52) U.S. Cl.
CPC ..... *A24F 40/46* (2020.01); *A24F 40/10* (2020.01)

(58) Field of Classification Search
CPC ..... A24F 40/48; A24F 40/44; A24F 40/40; A24F 40/10
See application file for complete search history.

(56) References Cited

U.S. PATENT DOCUMENTS

| | | | | |
|---|---|---|---|---|
| 11,992,053 | B2 | 5/2024 | Shen et al. | |
| 2009/0039417 | A1 | 2/2009 | Chen et al. | |
| 2014/0060554 | A1* | 3/2014 | Collett | A24F 40/30 392/386 |
| 2018/0066367 | A1 | 3/2018 | Galetz et al. | |
| 2019/0098935 | A1 | 4/2019 | Phan et al. | |
| 2019/0373953 | A1* | 12/2019 | Atkins | A24F 40/44 |
| 2022/0039470 | A1* | 2/2022 | Courbat | A24F 40/48 |
| 2022/0408817 | A1 | 12/2022 | Lv et al. | |
| 2024/0407450 | A1* | 12/2024 | Batista | A24F 40/57 |

FOREIGN PATENT DOCUMENTS

| | | | |
|---|---|---|---|
| CN | 1693286 | A | 11/2005 |
| CN | 102796406 | A | 11/2012 |
| CN | 104768407 | A | 7/2015 |
| CN | 108088610 | A | 5/2018 |

(Continued)

OTHER PUBLICATIONS

European Patent Office, Search Report in European Patent Application No. 23167227.0 (Sep. 20, 2023).

(Continued)

*Primary Examiner* — Alex B Efta
(74) *Attorney, Agent, or Firm* — Leydig, Voit & Mayer, Ltd.

(57) ABSTRACT

A vaporization core includes: a porous substrate having a vaporization surface; a heating layer arranged on the vaporization surface of the porous substrate; and an oxide layer arranged on a surface of the heating layer away from the porous substrate. In an embodiment, the oxide layer comprises aluminum oxide and/or silicon oxide.

8 Claims, 3 Drawing Sheets

(56) References Cited

FOREIGN PATENT DOCUMENTS

| | | | |
|---|---|---|---|
| CN | 109414078 | A | 3/2019 |
| CN | 110447959 | A | 11/2019 |
| CN | 110922213 | A | 3/2020 |
| CN | 111387555 | A | 7/2020 |
| CN | 112251723 | A | 1/2021 |
| CN | 112369717 | A | 2/2021 |
| CN | 112385898 | A | 2/2021 |
| CN | 212590295 | U | 2/2021 |
| CN | 112552077 | A | 3/2021 |
| CN | 112675884 | A | 4/2021 |
| CN | 112919932 | A | 6/2021 |
| CN | 112931952 | A | 6/2021 |
| CN | 113141678 | A | 7/2021 |
| CN | 113475755 | A | 10/2021 |
| CN | 214509370 | U | 10/2021 |
| CN | 113615887 | A | 11/2021 |
| CN | 113826962 | A | 12/2021 |
| CN | 216059228 | U | 3/2022 |
| CN | 216059229 | U | 3/2022 |
| CN | 114287676 | A | 4/2022 |
| CN | 110922213 | B | 11/2022 |
| CN | 217771488 | U | 11/2022 |
| CN | 217791478 | U | 11/2022 |
| EP | 2499106 | | 9/2012 |
| EP | 2892373 | A0 | 7/2015 |
| EP | 3332657 | A1 | 6/2018 |
| EP | 4005419 | A1 | 6/2022 |
| JP | 2015532828 | A | 11/2015 |
| JP | 20182994 | A | 1/2018 |
| JP | 2019533473 | A | 11/2019 |
| JP | 2020147631 | A | 9/2020 |
| JP | 2021521862 | A | 8/2021 |
| JP | 202261938 | A | 4/2022 |
| WO | 2011057730 | A1 | 5/2011 |
| WO | 2014037794 | A2 | 3/2014 |
| WO | 2021064124 | A1 | 4/2021 |
| WO | 2021098408 | A1 | 5/2021 |
| WO | 2021143328 | A1 | 7/2021 |
| WO | 2021233791 | A1 | 11/2021 |
| WO | 2022021036 | A1 | 2/2022 |

OTHER PUBLICATIONS

European Patent Office, Search Report in European Patent Application No. 23165768.5 (Aug. 22, 2023).
European Patent Office, Search Report in European Patent Application No. 23165048.2 (Sep. 11, 2023).
Japanese Patent Office, Decision of Refusal in Japanese Patent Application No. 2023-052341 (Jul. 23, 2024).
Japanese Patent Office, Notice of Reasons for Refusal in Japanese Patent Application No. 2023-052341 (Apr. 16, 2024).
Japanese Patent Office, Notice of Reasons for Refusal in Japanese Patent Application No. 2023-067871 (Jun. 18, 2024).
Japanese Patent Office, Decision to Grant a Patent in Japanese Patent Application No. 2023-069321 (Jun. 18, 2024).
Chinese Patent Office, Office Action in Chinese Patent Application No. 202210418915.9 (Dec. 14, 2024).
Japanese Patent Office, Decision to Grant a Patent in Japanese Patent Application No. 2023-067871 (Nov. 19, 2024).
Japanese Patent Office, Decision to Grant a Patent in Japanese Patent Application No. 2023-052341 (Dec. 3, 2024).
Chinese Patent Office, Office Action in Chinese Patent Application No. 202210418914.4 (Jun. 7, 2025).
Chinese Patent Office, Office Action in Chinese Patent Application No. 202210418908.9 (Jun. 20, 2025).
Chinese Patent Office, Rejection Decision in Chinese Patent Application No. 202210418915.9 (Jul. 19, 2025).
Chinese Patent Office, Office Action in Chinese Patent Application No. 202210418914.4 (Oct. 12, 2025).
Chinese Patent Office, Office Action in Chinese Patent Application No. 202210418908.9 (Oct. 11, 2025).
U.S. Patent and Trademark Office, Office Action in U.S. Appl. No. 18/191,366 (Sep. 17, 2025).
U.S. Patent and Trademark Office, Office Action in U.S. Appl. No. 18/302,250 (Nov. 17, 2025).
Chinese Patent Office, Rejection Decision in Chinese Patent Application No. 202210418914.4 (Jan. 1, 2026).
Chinese Patent Office, Rejection Decision in Chinese Patent Application No. 202210418908.9 (Jan. 12, 2026).
U.S. Patent and Trademark Office, Notice of Allowance in U.S. Appl. No. 18/191,366 (Mar. 17, 2026).

* cited by examiner

VAPORIZATION CORE, VAPORIZER, AND ELECTRONIC VAPORIZATION DEVICE

CROSS-REFERENCE TO PRIOR APPLICATION

Priority is claimed to Chinese Patent Application No. 202210418914.4, filed on Apr. 20, 2022, the entire disclosure of which is hereby incorporated by reference herein.

FIELD

This application relates to the technical field of vaporizers, and in particular, to a vaporization core, a vaporizer, and an electronic vaporization device.

BACKGROUND

An electronic vaporization device is generally composed of a vaporizer and a power supply assembly. The power supply assembly is configured to supply power to the vaporizer, and the vaporizer heats and vaporizes an aerosol generation substrate in an energized state to generate an aerosol for a user to inhale. The vaporization core includes a porous substrate and a heating element. A heating vaporization process of the vaporizer is mainly heating through the heating element of the vaporization core in the energized state, so as to heat and vaporize the aerosol generation substrate.

Generally, the heating element of the vaporization core is a metal heating film, but in the process of the vaporization, the metal heating film may oxidize and fail when the oil supply is insufficient, which affects the stability and the service life of the product.

SUMMARY

In an embodiment, the present invention provides a vaporization core, comprising: a porous substrate having a vaporization surface; a heating layer arranged on the vaporization surface of the porous substrate; and an oxide layer arranged on a surface of the heating layer away from the porous substrate.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
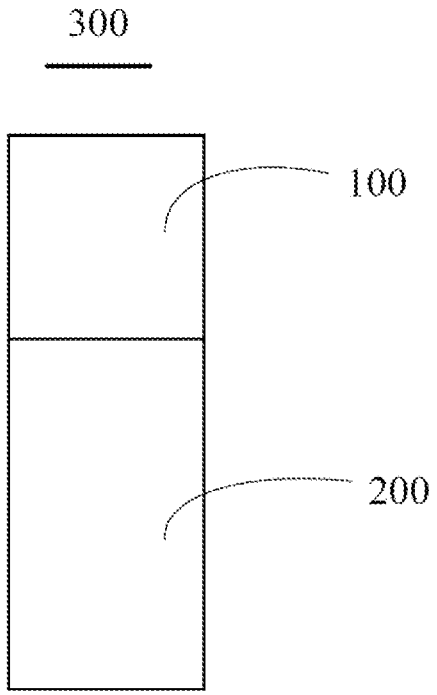
FIG. 1 is a schematic structural diagram of an electronic vaporization device according to this application.

In an embodiment, the present invention provides a vaporization core, a vaporizer, and an electronic vaporization device, to solve the technical problem that a metal heating film on a vaporization core is easy to fail and has a short life in a vaporization process in the prior art.

In an embodiment, the present invention provides a vaporization core. The vaporization core includes a porous substrate, a heating layer, and an oxide layer. The porous substrate has a vaporization surface, the heating layer is arranged on the vaporization surface of the porous substrate, and the oxide layer is arranged on a surface of the heating layer away from the porous substrate.

The oxide layer includes aluminum oxide and/or silicon oxide. The thickness of the oxide layer ranges from 200 nm to 600 nm.

The oxide layer is formed on the surface of the heating layer away from the porous substrate through physical vapor deposition.

The vaporization core further includes two electrodes, and the two electrodes are arranged on the surface of the heating layer away from the porous substrate. The oxide layer and the two electrodes jointly cover the heating layer.

The thickness of the oxide layer is less than the thickness of the electrode. The heating layer is a porous heating film.

The oxide layer is a porous structure.

The porous substrate is a porous ceramic substrate or a porous dense substrate.

In order to resolve the foregoing technical problem, another technical solution adopted in this application is as follows. A vaporizer is provided. The vaporizer includes a liquid storage cavity configured to store an aerosol generation substrate and the vaporization core of any of the above. The vaporization core is configured to absorb, heat, and vaporize the aerosol generation substrate in the liquid storage cavity.

In order to resolve the foregoing technical problem, still another technical solution adopted in this application is as follows. An electronic vaporization device is provided. The electronic vaporization device includes a power supply assembly and the vaporizer of any of the above. The power supply assembly provides energy for the vaporizer.

Beneficial effects of this application are as follows. Different from the prior art, this application discloses a vaporization core, a vaporizer, and an electronic vaporization device. The vaporization core includes a porous substrate, a heating layer, and an oxide layer. The porous substrate has a vaporization surface, the heating layer is arranged on the vaporization surface of the porous substrate, and the oxide layer is arranged on a surface of the heating layer away from the porous substrate. The oxide layer is arranged on the surface of the heating layer away from the porous substrate, so that the oxide layer protects the heating layer in the process of heating and vaporization to avoid the failure of the heating layer due to oxidation in the process of the vaporization, thereby improving the stability of the heating layer, and further increasing the service life of the heating layer.

The technical solutions in embodiments of this application are clearly and completely described below with reference to the accompanying drawings in the embodiments of this application. Apparently, the described embodiments are merely some rather than all of the embodiments of this application. All other embodiments derived by a person of ordinary skill in the art based on the embodiments of this application without creative efforts shall fall within the protection scope of this application.

The terms “first”, “second”, and “third” in the embodiments of this application are merely intended for a purpose of description, and shall not be understood as an indication or implication of relative importance or implicit indication of the number of indicated technical features. Therefore, features defining "first", "second", and "third" may explicitly or implicitly include at least one of the features. In description of this application, "a plurality of" means at least two, such as two and three, unless otherwise specifically defined. In addition, the terms "include", "have", and any variant thereof are intended to cover a non-exclusive inclusion. For example, a process, a method, a system, a product, or a device that includes a series of steps or units is not limited to the listed steps or units, and instead, further optionally includes a step or unit that is not listed, or further optionally includes another step or unit that is intrinsic to the process, method, product, or device.

Embodiments mentioned in the specification mean that particular features, structures, or characteristics described with reference to the embodiments may be included in at least one embodiment of this application. The term appearing at different positions of this specification may not be the same embodiment or an independent or alternative embodiment that is mutually exclusive with other embodiments. A person skilled in the art explicitly or implicitly understands that the embodiments described in the specification may be combined with other embodiments.

Figure 2:
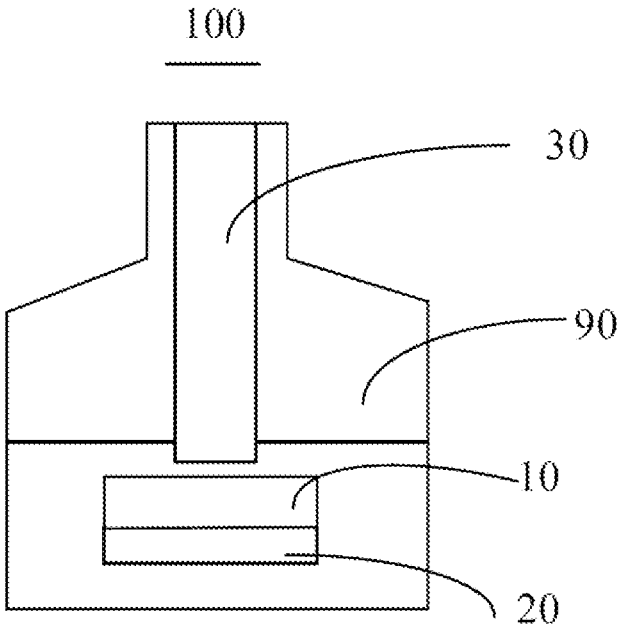
FIG. 2 is a schematic structural diagram of a vaporizer of the electronic vaporization device provided in FIG. 1.

Referring to FIG. 1 and FIG. 2, FIG. 1 is a schematic structural diagram of an electronic vaporization device according to this application, and FIG. 2 is a schematic structural diagram of a vaporizer in the electronic vaporization device provided in FIG. 1.

Referring to FIG. 1, this application provides an electronic vaporization device 300. The electronic vaporization device 300 includes a vaporizer 100 and a power supply assembly 200. The power supply assembly 200 is configured to provide energy to the vaporizer 100, and the vaporizer 100 is configured to heat and vaporize an aerosol generation substrate in an energized state to generate an aerosol for a user to inhale.

Optionally, the vaporizer 100 and the power supply assembly 200 in the electronic vaporization device 300 may be integrally formed or may be detachably connected, which may be designed according to a specific requirement.

As shown in FIG. 2, the vaporizer 100 includes a liquid storage cavity 90, an air outlet tube 30, a vaporization core 10, and a vaporization cavity 20 formed in the vaporizer 100. The liquid storage cavity 90 is configured to store an aerosol generation substrate, and the vaporization core 10 is configured to adsorb the aerosol generation substrate in the liquid storage cavity 90, and heat and vaporize the absorbed aerosol generation substrate to finally generate an aerosol. The aerosol generated by the vaporization is in the vaporization cavity 20 and flows through the air outlet tube 30 with an external airflow, and finally flows out of the vaporizer 100 to be inhaled by the user.

A heating element of the vaporization core is generally a metal heating film. Nano particles of the metal heating film are prone to oxidation and failure during sintering and vaporization, especially in the case of insufficient oil supply. For the problem that the metal heating film layer is prone to oxidation and failure, a protective layer formed by precious metals such as gold and platinum is generally arranged on the surface of the metal heating film in the prior art to solve the technical problem. However, the particles made of gold and platinum are prone to overburning when there is a small number of aerosol generation substrates, causing agglomeration of the precious metal particles, and the metal heating film is exposed to the air and oxidizes and fails. In view of this, this application provides a vaporization core 10. Details are described as follows.

Figure 3:
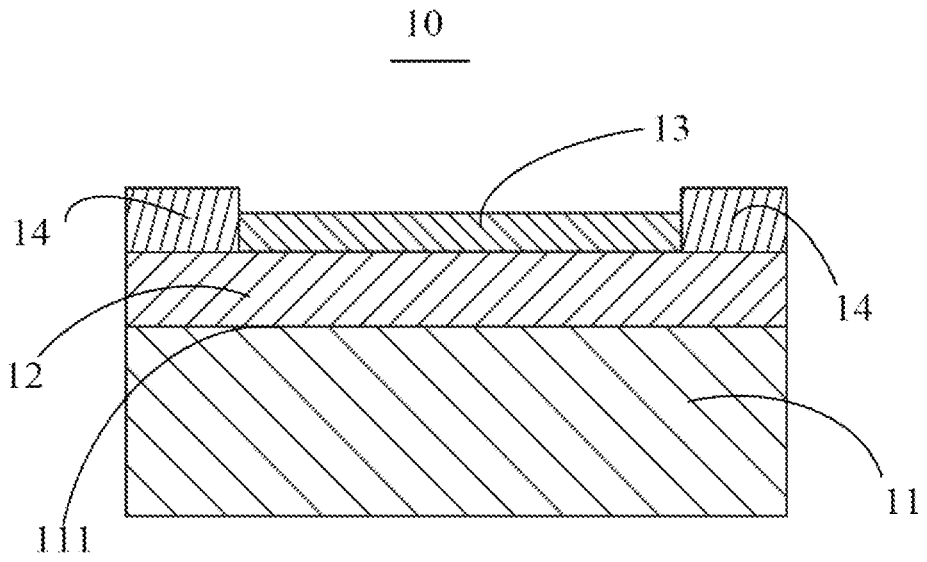
FIG. 3 is a schematic structural diagram of an embodiment of a vaporization core in FIG. 2.
Figure 4:
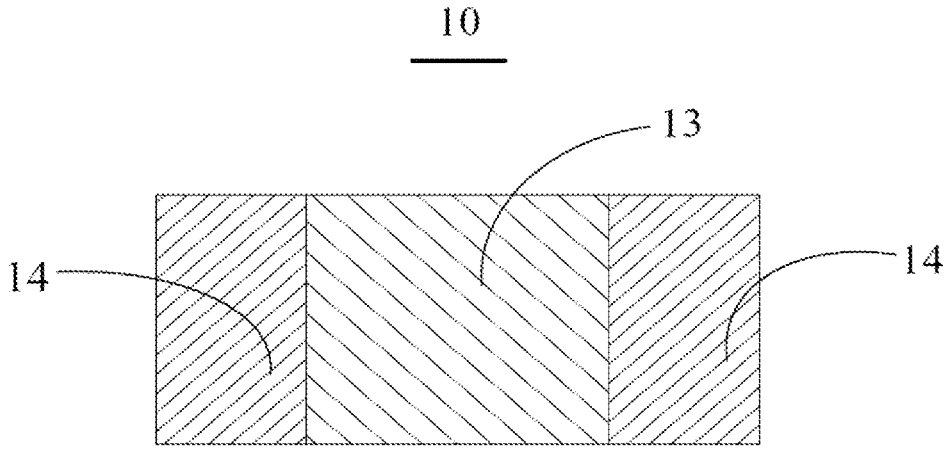
FIG. 4 is a schematic structural top view of the vaporization core provided in FIG. 3.

Referring to FIG. 3 and FIG. 4, FIG. 3 is a schematic structural diagram of an embodiment of a vaporization core in FIG. 2, and FIG. 4 is a schematic structural top view of the vaporization core provided in FIG. 3.

The vaporization core 10 includes a porous substrate 11, a heating layer 12, and an oxide layer 13. The porous substrate 11 has a vaporization surface 111, the heating layer 12 is arranged on the vaporization surface 111 of the porous substrate, and the oxide layer 13 is arranged on a surface of a side of the heating layer 12 away from the porous substrate 11. The oxide layer 13 is arranged on the surface of the side of the heating layer 12 away from the porous substrate 11 to protect the heating layer 12. Direct contact between the heating layer 12 and the air is isolated to avoid leading to the failure of the heating layer 12 due to the oxidation of the heating layer 12 in a heated environment, which can help improve the stability of the heating layer 12, and prolong the service life of the heating layer 12.

In this embodiment, specifically, the oxide layer 13 may be made of aluminum oxide or silicon oxide or a mixture of the aluminum oxide and the silicon oxide. The oxide layer 13 is made of oxides and has strong antioxidant capacity, and the aluminum oxide and the silicon oxide are both oxides with high stability and stable performance. Therefore, the oxide layer 13 is not prone to an oxidation reaction to change the performance when contacting the air during the vaporization, thereby ensuring the stability of the vaporization core 10. In addition, a melting point and a boiling point of the aluminum oxide and the silicon oxide are relatively high, and have strong resistance to high temperature. During the vaporization, even if overburning occurs when the aerosol generation substrate in the vaporization core 10 is insufficient, particle aggregation does not occur on the oxide layer 13 due to the overburning, resulting in the failure of the vaporization core 10. This effectively solves the problem of the failure of the vaporization core 10 as a result of the precious metal particle agglomeration caused by the overburning of the precious metal materials when the protective layer is made of precious metal materials such as gold and platinum and a small number of aerosol generation substrates exist in the vaporization core 10 in the prior art, which improves the stability of the vaporization core 10, and prolongs the service life of the vaporization core 10. In addition, compared with the protective layer made of the precious metal material, the protective layer of the heating layer 12 made of the oxide has lower costs, which effectively saves the production cost of the vaporizer 100.

The oxide layer 13 is prepared by depositing the oxide on the surface of the side of the heating layer 12 away from the porous substrate 11. Specifically, in this embodiment, the oxide layer 13 is prepared by sputtering the oxide by using a sputtering process. Optionally, the sputtering process may be a DC sputtering process, an AC sputtering process, a magnetron sputtering process, or the like. The aluminum oxide and the silicon oxide used for the oxide layer 13 are materials having high density. However, since the oxide layer 13 is prepared on the surface of the heating layer 12 by the sputtering process, the structure of the oxide layer 13 is also a porous structure due to the production process.

The thickness of the oxide layer 13 ranges from 200 nm to 600 nm, so as to ensure that oxide layer 13 can better protect the heating layer 12. It may be understood that if the thickness of the oxide layer 13 is excessively small, the structural strength of the oxide layer 13 is relatively low, the ability to block air is also weakened, and the protective effect on the heating layer 12 is weakened accordingly, which causes the air to still contact the heating layer 12, so that the heating layer 12 is oxidized, leading to the failure of the vaporization core 10. In addition, the inventor found that oxide layer 13 should not be excessively thick. On one hand, the thermal conductivity of the oxide layer 13 itself is less than that of the metal material. If the thickness is excessively large, a heating rate of the vaporization surface 111 is affected and an amount of the aerosol generated by the vaporization is also affected. On the other hand, since the vaporization surface 111 is a porous structure, an excessively thick oxide layer 13 blocks the porous structure and reduces the liquid guiding rate, and then causes problems such as an abnormal high temperature and dry burning.

In other embodiments, the oxide layer 13 may also be manufactured by using other process technologies, so as to protect the heating layer 12.

A shape and a size of the porous substrate 11 are not limited. The porous substrate 11 is made of a material having a porous structure, for example, the porous substrate 11 may be made of porous ceramic, porous glass, porous plastic, porous metal, and the like. In this embodiment, the material of the porous substrate 11 is a porous ceramic substrate. The porous ceramic has pores functioning to guide and store liquid, so that the aerosol generation substrate in the liquid storage cavity 90 is absorbed by the porous substrate 11 and then permeates to the vaporization surface 111 for heating and vaporization. In addition, the porous ceramic has a stable chemical property, and does not produce chemical reaction with the aerosol generation substrate, and the porous ceramic can bear high temperature, and is not deformed due to the excessively high heating temperature during the vaporization. The porous ceramic is an insulator and is not electrically connected to the heating layer 12 on the surface, causing the failure of the vaporization core 10 due to a short circuit, and the porous ceramic is easy to manufacture and low in cost. In this embodiment, the porous substrate 11 is a rectangular porous ceramic.

In some embodiments, the porosity of the porous ceramic ranges from 30% to 70%. The porosity is a ratio of a total volume of tiny gaps in a porous medium to a total volume of the porous medium. A value of the porosity may be adjusted according to the composition of the aerosol generation substrate. For example, when the viscosity of the aerosol generation substrate is large, a higher porosity is selected to ensure the liquid guiding effect.

In some other embodiments, the porosity of the porous ceramic ranges from 50% to 60%. The porosity of the porous ceramic ranges from 50% to 60%. On the one hand, it may be ensured that the porous ceramic has better liquid guiding efficiency and prevent the phenomenon of dry burning due to unsmooth flow of the aerosol generation substrate, so as to improve the vaporization effect of the vaporizer 100; and On the other hand, the porosity of the porous ceramic may be prevented from being excessively large, the liquid is guided too fast and is difficult to lock, resulting in an increased probability of the liquid leakage, and affecting the performance of the vaporizer 100.

In other embodiments, when the porous substrate 11 is made of other materials with the porous structure, the ratio of the porosity in the porous substrate 11 may be set according to the setting form on the porous ceramic. Details are not described herein again in this application.

It may be understood that when the porous substrate 11 is porous glass, porous plastic, or porous metal, the porous substrate may be the porous glass, the porous plastic, or the porous metal formed by forming a hole on a dense glass substrate, plastic substrate, or metal substrate.

When the porous substrate 11 is the porous metal, an insulating layer is arranged between the porous substrate 11 and the heating layer 12. The insulating layer is configured to insulate the porous substrate 11 and the heating layer 12 to avoid the short circuit caused by the electrical connection between the porous substrate 11 and the heating layer 12.

The heating layer 12 is arranged on the vaporization surface 111 of the porous substrate 11, and generates heat in an energized state to heat and vaporize the aerosol generation substrate. Optionally, the heating layer 12 may be at least one of a heating film, a heating coating, a heating line, a heating sheet, or a heating mesh. In this embodiment, the heating layer 12 is a porous heating film structure. It may be understood that the porous structure on the heating layer 12 allows the liquid aerosol generation substrate to permeate into the surface of the heating layer 12 or the vaporization surface 111 more efficiently, so as to improve the liquid guiding efficiency and thermal conductivity of the heating layer 12 and improve the vaporization effect of the vaporization core 10.

The heating layer 12 may be made of a material allowing stable combination with the porous substrate 11. For example, the heating layer 12 made be made of a material such as titanium, zirconium, a titanium-aluminum alloy, a titanium-zirconium alloy, a titanium-molybdenum alloy, a titanium-niobium alloy, an iron-aluminum alloy, a tantalum-aluminum alloy, stainless steel.

Titanium and zirconium have the following characteristics. Titanium and zirconium are both biocompatible metals, especially titanium is also a pro-biotic metal element with higher safety. Titanium and zirconium have larger resistivity among metallic materials, and have three times the original resistivity after alloying in certain proportion at room temperature, and therefore are more suitable to be the material of the heating layer 12. Titanium and zirconium have small coefficients of thermal expansion and have smaller coefficients of thermal expansion after alloying and a better heat match with the porous ceramic. After alloying in certain proportion, a melting point of the alloy is lower, and a film-forming property of the magnetron sputtering is better. After the metal coating, it can be seen through electron microscope analysis that microscopic particles are spherical, and the particles gather together to form a microscopic morphology similar to cauliflower. It can be seen through the electron microscopic analysis that microscopic particles of the film formed by the titanium-zirconium alloy are flaky, a part of grain boundaries between the particles disappears, and the continuity is better. Titanium and zirconium both have good plasticity and elongation, and the resistance to a thermal cycle and current impacting of the titanium-zirconium alloy film is better. Titanium is often used as a stress buffer layer for the metal and the ceramic and an activating element for ceramic metallization. Titanium reacts with a ceramic interface to form a relatively strong chemical bond, so as to improve an adhesive force of the film. Based on the above characteristics of titanium and zirconium, in this embodiment, the heating layer 12 is made of the titanium-zirconium alloy.

The thickness of the heating layer 12 ranges from 0.1 μm to 10 μm. Specifically, the thickness of the heating layer 12 may be any specific value of 0.1 μm, 1 μm, 2 μm, 3 μm, 4 μm, 5 μm, 6 μm, 7 μm, 8 μm, 9 μm, or 10 μm. Preferably, the thickness of the heating layer 12 ranges from 2 μm to 5 μm. The thickness can ensure that the thickness of the heating layer 12 matches a pore size of the porous substrate 11, so as to prevent the heating layer 12 from blocking the micro-pore for guiding and storing liquid in the porous substrate 11, thereby improving the stability of liquid supply in the vaporization process of the vaporization core 10, and increasing the service life.

Optionally, the heating layer 12 may be manufactured on the vaporization surface 111 of the porous substrate 11 by using a process such as physical vapor deposition or chemical vapor deposition. For example, the heating layer 12 may be manufactured by using process technologies such as sputtering, evaporation coating, atomic layer deposition, and the like.

In this embodiment, the titanium-zirconium alloy film made of the titanium-zirconium alloy is a locally dense film, but the titanium-zirconium alloy film formed on the surface of the porous substrate 11 also becomes a porous continuous structure since the porous substrate 11 itself is the porous structure, and a pore size of the titanium-zirconium alloy film is slightly smaller than a pore size of the micro-pore on the surface of the porous substrate 11.

Referring to FIG. 3, in this embodiment, the vaporization core 10 further includes two electrodes 14. The two electrodes 14 are respectively electrically connected to the power supply assembly 200 in the electronic vaporization device 300, and are configured to supply power to the heating layer 12 of the vaporization core 10, so that the heating layer 12 generates heat in an energized state, and then heats and vaporizes the aerosol generation substrate absorbed in the porous substrate 11 to generate the aerosol.

Specifically, as shown in FIG. 3 and FIG. 4, the two electrodes 14 are both arranged on the surface of the side of the heating layer 12 away from the porous substrate 11 and are respectively located on two sides of the oxide layer 13. The oxide layer 13 covers a part of the heating layer 12 that is not covered by the two electrodes 14 to ensure that heating layer 12 is completely covered by the oxide layer 13 and the two electrodes 14, and cannot contact the air to oxidize during vaporization, so as to avoid the failure of the heating layer 12 due to the oxidation, thereby improving the stability of the vaporization core 10 and extending the service life of the vaporization core 10. The thickness of the two electrodes 14 is greater than the thickness of the oxide layer 13, which also facilitates the electrical connection between the power supply assembly 200 and the electrodes 14 through an electrical connector while ensuring good contact between the electrodes 14 and the heating layer 12, thereby improving the contact stability between the electrode 14 and the electrical connector. In addition, the thickness of the oxide layer 13 is relatively small, the oxide layer absorbs less heat, the electric heating loss is low, and the vaporization core 10 has a high temperature rise rate.

Figure 5:
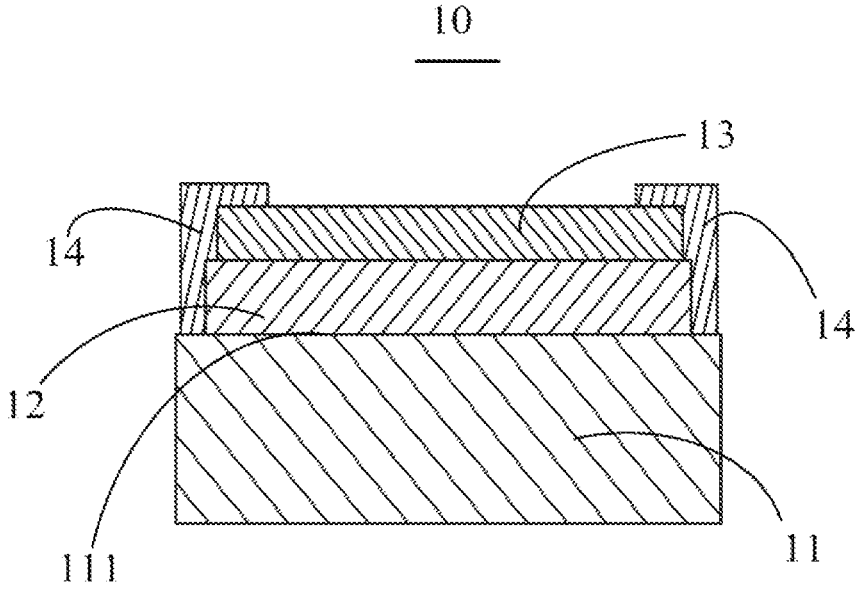
FIG. 5 is a schematic structural diagram of another implementation of the vaporization core in FIG. 2.

In another implementation, as shown in FIG. 5, the oxide layer 13 is arranged on the surface of the side of the heating layer 12 away from the porous substrate 11, and the two electrodes 14 are arranged at intervals on the surface of the side of the oxide layer 13 away from the porous substrate 11. The two electrodes 14 cover the part of the heating layer 12 that is not covered by the oxide layer 13, and the two electrodes 14 both contact the oxide layer 13, the heating layer 12, and the porous substrate 11. The two electrodes 14 both cover the side surfaces of the oxide layer 13 and the heating layer 12 to prevent a gap from existing between the electrode 14 and the oxide layer 13 when the electrode 14 is arranged on two sides of the oxide layer 13, which cannot completely isolate the contact between the air and the heating layer 12, resulting in the failure of the vaporization core 10.

Figure 6:
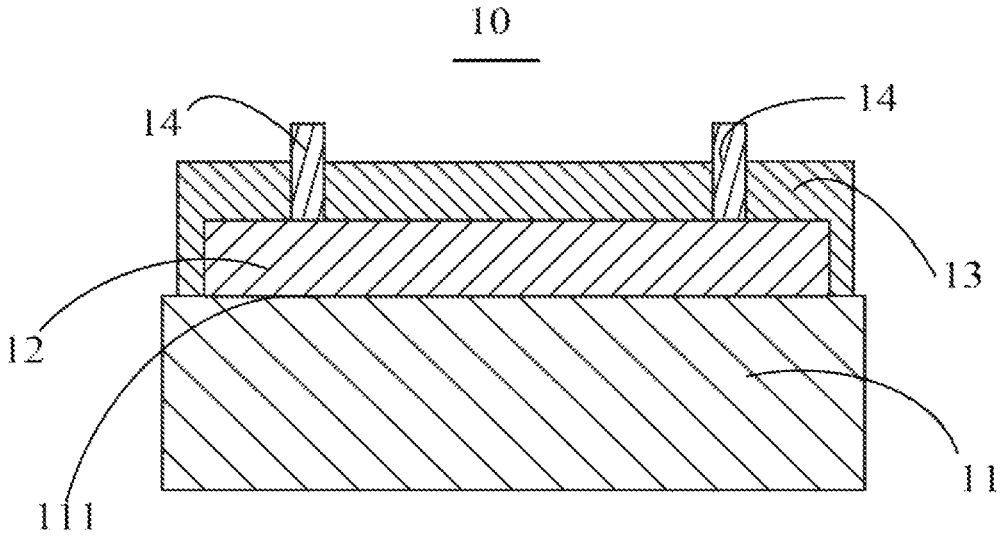
FIG. 6 is a schematic structural diagram of still another implementation of the vaporization core in FIG. 2.

In still another implementation, as shown in FIG. 6, the oxide layer 13 may also completely cover the surface of the heating layer 12 away from the porous substrate 11 and the side surface of the heating layer 12. That is to say, the oxide layer 13 completely wraps the heating layer 12 to completely isolate the heating layer 12 from the air. Two through holes spaced apart from each other are arranged on the oxide layer 13 by forming a hole, and the two electrodes 14 are electrically connected to the heating layer 12 through the two through holes in the oxide layer 13, respectively. The two electrodes 14 are exposed from the surface of the side of the oxide layer 13 away from the porous substrate 11 and are electrically connected to the power supply assembly 200.

Different from the prior art, this application discloses a vaporization core, a vaporizer, and an electronic vaporization device. The vaporization core in this application includes a porous substrate, a heating layer, and an oxide layer. The porous substrate has a vaporization surface, the heating layer is arranged on the vaporization surface of the porous substrate, and the oxide layer is arranged on a surface of the heating layer away from the porous substrate. The oxide layer is arranged on the surface of the heating layer away from the porous substrate, so that the oxide layer protects the heating layer in the process of heating and vaporization to avoid the failure of the heating layer due to oxidation in the process of the vaporization, thereby improving the stability of the heating layer, and further increasing the service life of the heating layer.

The foregoing descriptions are merely embodiments of this application, and are not intended to limit the patent scope of this application. All equivalent structures or process changes made according to the content of this specification and accompanying drawings in this application or direct or indirect application in other related technical fields shall fall within the protection scope of this application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporization core, comprising:

a porous substrate having a vaporization surface;

a heating layer arranged on the vaporization surface of the porous substrate;

an oxide layer arranged on a surface of the heating layer away from the porous substrate, wherein the oxide layer is configured to isolate the heating layer from air;

two electrodes arranged on the surface of the heating layer away from the porous substrate, wherein the oxide layer and the two electrodes jointly cover the heating layer, and wherein a thickness of the oxide layer is less than a thickness of the electrodes.

2. The vaporization core of claim 1, wherein the oxide layer comprises aluminum oxide and/or silicon oxide.

3. The vaporization core of claim 1, wherein a thickness of the oxide layer ranges from 200 nm to 600 nm.

4. The vaporization core of claim 1, wherein the oxide layer is formed on a surface of the heating layer away from the porous substrate through physical vapor deposition.

5. The vaporization core of claim 1, wherein the heating layer comprises a porous heating film.

6. The vaporization core of claim 1, wherein the porous substrate comprises a porous ceramic substrate, a porous glass substrate, a porous plastic substrate, or a porous metal substrate.

7. A vaporizer, comprising:

a liquid storage cavity configured to store an aerosol generation substrate; and the vaporization core of claim 1, the vaporization core being configured to absorb, heat, and vaporize the aerosol generation substrate in the liquid storage cavity.

8. An electronic vaporization device, comprising:

a power supply assembly; and the vaporizer of claim 7, wherein the power supply assembly is configured to provide energy for the vaporizer.

* * * * *